US011279584B2

(12) United States Patent
Izumichi et al.

(10) Patent No.: US 11,279,584 B2
(45) Date of Patent: Mar. 22, 2022

(54) SHEET CONVEYING DEVICE AND IMAGE FORMING SYSTEM THEREWITH

(71) Applicant: KYOCERA Document Solutions Inc., Osaka (JP)

(72) Inventors: Sachio Izumichi, Osaka (JP); Takuya Nishimura, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/197,299

(22) Filed: Mar. 10, 2021

(65) Prior Publication Data

US 2021/0284478 A1 Sep. 16, 2021

(30) Foreign Application Priority Data

Mar. 12, 2020 (JP) ..... JP2020-043180

(51) Int. Cl.
*B65H 31/24* (2006.01)
*B65H 37/04* (2006.01)
*B65H 29/14* (2006.01)

(52) U.S. Cl.
CPC ..... *B65H 31/24* (2013.01); *B65H 29/14* (2013.01); *B65H 37/04* (2013.01)

(58) Field of Classification Search
None
See application file for complete search history.

(56) References Cited

U.S. PATENT DOCUMENTS

| | | | | |
|---|---|---|---|---|
| 9,561,925 | B2 * | 2/2017 | Sato | B65H 7/00 |
| 9,758,336 | B2 * | 9/2017 | Kurokawa | B65H 31/02 |
| 10,737,896 | B2 * | 8/2020 | Ito | B65H 29/14 |
| 2011/0227272 | A1 | 9/2011 | Kotera | 271/4.1 |

FOREIGN PATENT DOCUMENTS

| | | | |
|---|---|---|---|
| JP | 2003-73009 A | | 3/2003 |
| JP | 2003073009 A | * | 3/2003 |
| JP | 2011-195277 A | | 10/2011 |

* cited by examiner

*Primary Examiner* — Leslie A Nicholson, III
(74) *Attorney, Agent, or Firm* — Stein IP, LLC

(57) ABSTRACT

A sheet conveying device includes a sheet conveying passage, an upper conveying guide provided in the sheet conveying passage and facing the upper surface of a sheet, a lower conveying guide facing the lower surface of the sheet, a conveying member conveying the sheet along the sheet conveying passage, a sheet stack tray arranged above the upper conveying guide. The upper conveying guide is swingable up and down, with one end part of it in the sheet conveying direction or in the sheet width direction perpendicular to the sheet conveying direction serving as a pivot shaft. The sheet stack tray has a movable part making contact with the upper conveying guide at least when it swings, and the movable part is movable between a sheet receiving position where it forms a sheet stack surface and a retracted position where it has swung upward from the sheet receiving position.

10 Claims, 7 Drawing Sheets

SHEET CONVEYING DEVICE AND IMAGE FORMING SYSTEM THEREWITH

INCORPORATION BY REFERENCE

This application is based on and claims the benefit of Japanese Patent Application No. 2020-43180 filed on Mar. 12, 2020, the contents of which are hereby incorporated by reference.

BACKGROUND

The present disclosure relates to a sheet conveying device for conveying sheets, and to an image forming system including a sheet conveying device.

Image forming apparatuses with an in-body discharge space secured between an image forming portion and an image reading portion arranged over the image forming portion are known. In an image forming apparatus with an in-body discharge space, sheets (typically of paper) having images formed on them are discharged onto a tray provided in the in-body discharge space.

When an image forming apparatus with an in-body discharge space is fitted with a post-processing device for performing post-processing such as punching and stapling, the post-processing device is fitted outside the in-body discharge space, and a relay conveying unit in which a conveying passage for conveying sheets having images formed on them to the post-processing device is formed is mounted in the in-body discharge space. On the other hand, when sheets having images formed on them do not need to be subjected to post-processing, they are discharged onto a separate tray provided over the relay unit in the in-body discharge space.

There is a known construction where, as a means for coping with a sheet jam inside the relay conveying unit, a lower conveying guide and an upper conveying guide of the relay conveying unit are pivotally coupled together so that the conveying passage in the relay conveying unit can be opened.

There is also a known image forming apparatus which is provided with a plurality of tiered sheet discharge trays and a relay sheet discharge portion for guiding sheets discharged into the in-body discharge space selectively to one of the sheet discharge trays wherein the relay sheet discharge portion is movable between a guiding position where it can guide sheets downward to the sheet discharge trays and a jam handling position where it allows a sheet jam to be coped with.

SUMMARY

According to one aspect of the present disclosure, a sheet conveying device includes a sheet conveying passage, an upper conveying guide, a lower conveying guide, a conveying member, and a sheet stack tray. A sheet passes through which the sheet conveying passage. The upper conveying guide is provided in the sheet conveying passage, and faces the upper surface of the sheet. The lower conveying guide is arranged under the upper conveying guide, and faces the lower surface of the sheet. The conveying member conveys the sheet along the sheet conveying passage. The sheet stack tray is arranged above the upper conveying guide, and on the sheet stack tray, the sheet is stacked. The upper conveying guide is swingable up and down, with one end of it in the sheet conveying direction or one end of it in the sheet width direction perpendicular to the sheet conveying direction serving as a pivot shaft. The sheet stack tray has a movable part that makes contact with the upper conveying guide at least when it swings, and the movable part is movable between a sheet receiving position where the movable part forms a sheet stack surface on which the sheet is stacked and a retracted position where the movable part has swung upward from the sheet receiving position.

This and other objects of the present disclosure, and the specific benefits obtained according to the present disclosure, will become apparent from the description of embodiments which follows.

DETAILED DESCRIPTION

Figure 1:
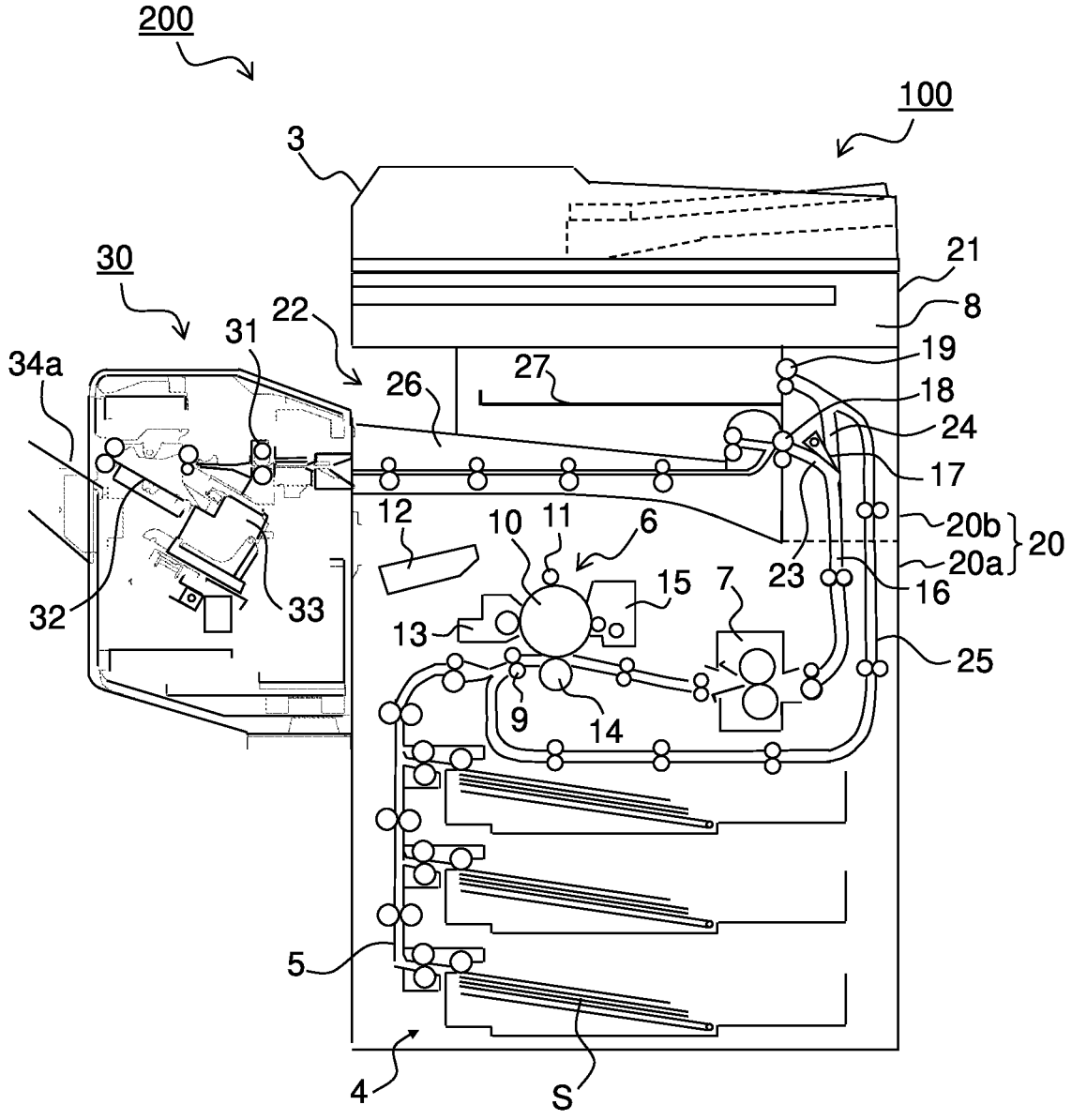
FIG. 1 is a diagram schematically showing an internal construction of an image forming system including an image forming apparatus according to a first embodiment of the present disclosure fitted with a relay conveying unit.

Embodiments of the present disclosure will be described in detail below with reference to the accompanying drawings. FIG. 1 is a diagram schematically showing an internal construction of an image forming system 200 including an image forming apparatus 100 according to a first embodiment of the present disclosure. As shown in FIG. 1, the image forming system 200 includes an image forming apparatus 100, as one example of a sheet conveying device according to the present disclosure fitted with a relay conveying unit 26, and a sheet post-processing device 30.

The image forming apparatus 100 is a digital multifunction peripheral of what is called an in-body sheet discharge type, and includes a main unit housing 20 and an upper housing 21 arranged on top of it. The main unit housing 20 is composed of a lower housing 20*a* and a coupling housing 20*b* coupled between the lower housing 20*a* and the upper housing 21 along the right side in FIG. 1. Inside the lower housing 20*a*, there are provided a sheet feed portion 4, a sheet conveying portion 5 arranged at the side of and over the sheet feed portion 4, an image forming portion 6 arranged over the sheet feed portion 4, and a fixing portion 7 arranged downstream (on the right side in FIG. 1) of the image forming portion 6 in the sheet conveying direction. In the coupling housing 20*b*, there is provided a sheet discharge portion for conveying sheets S having undergone fixing to discharge them out of the main unit housing 20.

The image forming portion 6 forms a predetermined toner image on a sheet S by an electrophotographic process. The image forming portion 6 includes a photosensitive drum 10 pivoted so as to be rotatable, and further includes, arranged around the photosensitive drum 10 along its rotation direction, a charging device 11, an exposure device 12, a developing device 13, a transfer device 14, a cleaning device 15, and a destaticizing device (not shown).

Inside the upper housing 21, an image reading portion 8 for reading image information on a document is provided. On top of the upper housing 21, a document conveying device 3 is arranged. When a bundle of document sheets is read automatically, the document conveying device 3 feeds one document sheet after another across a contact glass (not shown) provided on the top face of the image reading portion 8.

Under the upper housing 21, in a left part of the coupling housing 20*b*, an in-body discharge space 22 is formed which is wide open to the left and to the front. In the in-body discharge space 22, a relay conveying unit 26 is removably fitted which receives sheets S discharged by a pair of first discharge rollers 18 (conveying member) to convey them to the sheet post-processing device 30. Over the relay conveying unit 26, a separate tray 27 (sheet stack tray) is arranged on which sheets S discharged by a pair of second discharge rollers 19 (conveying member) are stacked. The structures of the relay conveying unit 26 and the separate tray 27 will be described later.

The sheet post-processing device 30 includes a punch hole forming device 31 for forming punch holes in sheets S conveyed to it, a processing tray 32 for stacking a plurality of sheets S conveyed to it, and a stapler 33 for binding with staples the bundle of sheets stacked on the processing tray 32. On a side face of the sheet post-processing device 30, a main tray 34*a* is provided which is movable up and down to a position suitable for the discharge of sheets S.

Now, the basic operation of the image forming system 200 constructed as described above will be described. First, the outer circumferential surface of the photosensitive drum 10, which rotates counter-clockwise in FIG. 1 in the image forming apparatus 100, is electrostatically charged by the charging device 11 uniformly. Based on the image information read by the image reading portion 8, a beam of light is shone from the exposure device 12 to the outer circumferential surface of the photosensitive drum 10, so that an electrostatic latent image is formed on the outer circumferential surface of the photosensitive drum 10. To the electrostatic latent image, toner is fed from the developing device 13, and thereby the electrostatic latent image is developed into a toner image.

Concurrently as the toner image is formed, a sheet S is fed from the sheet feed portion 4 into the sheet conveying portion 5, and stops momentarily at a pair of registration rollers 9. The sheet S that has stopped at the pair of registration rollers 9 is then, with predetermined timing, conveyed toward the photosensitive drum 10 having the toner image formed on it. Then, by the transfer device 14, which includes a transfer roller and the like, the toner image on the outer circumferential surface of the photosensitive drum 10 is transferred to the sheet S. The sheet S having the toner image transferred to it is separated from the photosensitive drum 10, and is conveyed toward the fixing portion 7. As the sheet S passes through the fixing portion 7, it is heated and pressed, so that the toner image is fixed to the sheet S.

When the transfer of the toner image to the sheet S is complete, the photosensitive drum 10 is cleaned by the cleaning device 15 to remove residual toner left on the outer circumferential surface, and is then destaticized by the destaticizing device (not shown) to eliminate residual electric charge. Thereafter, the outer circumferential surface of the photosensitive drum 10 is once again electrostatically charged by the charging device 11, and image formation continues through a similar procedure.

The sheet S having passed through the fixing portion 7 is, as it is, conveyed along a vertical conveying passage 16, which extends vertically upward, into the coupling housing 20*b*. A top part of the vertical conveying passage 16 branches into a first conveying passage 23 and a second conveying passage 24, located respectively lower and upper than each other inside the coupling housing 20*b*.

When a sheet S is subjected to post-processing by the sheet post-processing device 30, it is guided by a first branch guide 17 into the first conveying passage 23 (sheet conveying passage). The sheet S guided into the first conveying passage 23 is discharged leftward from the pair of first discharge rollers 18 to be conveyed into the relay conveying unit 26. The sheet S conveyed into the relay conveying unit 26 passes through a relay conveying passage 35 (see FIG. 2) inside the relay conveying unit 26 to be conveyed into the sheet post-processing device 30.

When a sheet S is not subjected to post-processing by the sheet post-processing device 30, it is guided by the first branch guide 17 into the second conveying passage 24. The sheet guided into the second conveying passage 24 is discharged leftward from the pair of second discharge rollers 19 to be stacked on the separate tray 27 arranged in the in-body discharge space 22. Instead, the sheet S conveyed into the relay conveying unit 26 may be conveyed via a discharge conveying passage 37 and a pair of third discharge rollers 40 (for both, see FIG. 2) to be stacked on a discharge tray 29 (see FIG. 2) on the top face of the relay conveying unit 26.

On the other hand, when both sides of a sheet S are subjected to printing, the sheet S is guided by the first branch guide 17 into the second conveying passage 24, and part of the sheet S is momentarily stuck out from the pair of second discharge rollers 19 into the separate tray 27. Next, the pair of second discharge rollers 19 is rotated reversely so that the sheet S is switched back. The sheet S is, now with the image side reversed, guided into a reverse conveying passage 25 to be conveyed once again to the pair of registration rollers 9. Then the next image formed on the outer circumferential surface of the photosensitive drum 10 is transferred by the transfer device 14 to the face of the sheet S having no image formed on it yet. Thereafter, the sheet S is conveyed to the fixing portion 7, where the toner image is fixed. The sheet S is then conveyed via the pair of first discharge rollers 18 and the relay conveying unit 26 into the sheet post-processing device 30, or discharged onto the discharge tray 29. Or the sheet S is discharged via the pair of second discharge rollers 19 onto the separate tray 27.

Figure 2:
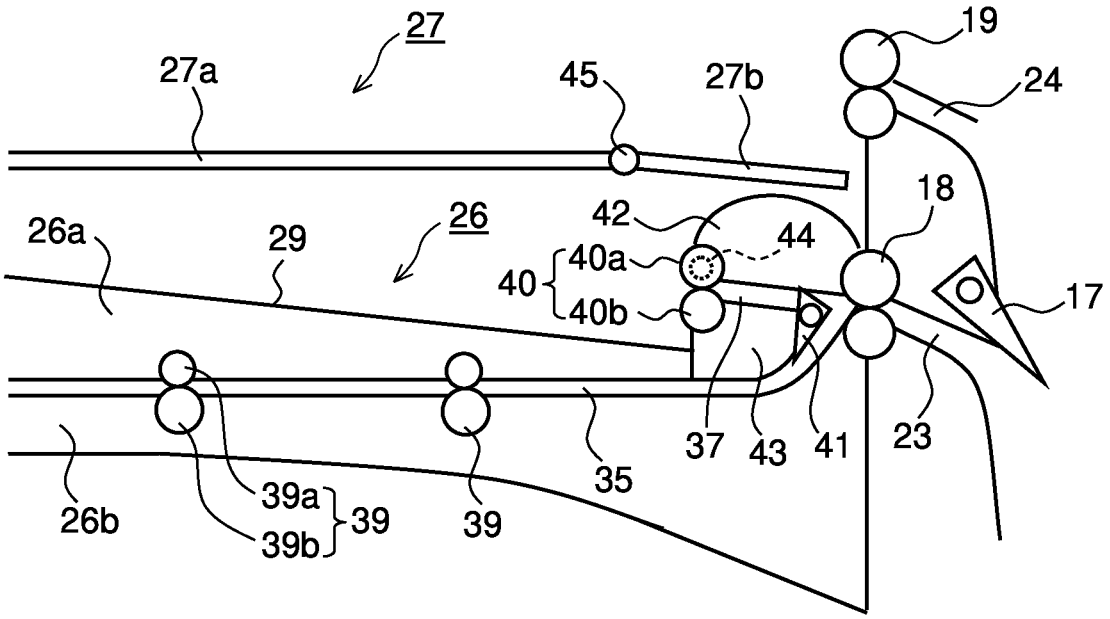
FIG. 2 is a sectional front view of and around a relay conveying unit and a separate tray in the image forming apparatus according to the first embodiment.

FIG. 2 is a sectional front view of and around the relay conveying unit 26 and the separate tray 27 in the image forming apparatus 100 of the first embodiment. The relay conveying unit 26 is fitted in a bottom part of the in-body discharge space 22 from the front side of the main unit of the image forming apparatus 100 (from the near side with respect to the plane of FIG. 1, in the direction parallel to the axial direction of the pair of first discharge rollers 18). As shown in FIG. 2, the relay conveying unit 26 includes an upper relay guide 26*a*, which faces the top face of the sheet S conveyed, and a lower relay guide 26*b*, which faces the bottom face of the sheet S conveyed. Between the upper and lower relay guides 26*a* and 26*b*, the relay conveying passage 35 is formed.

Along the relay conveying passage 35, a plurality of pairs of relay conveying rollers 39 are arranged, which convey the sheet S conveyed into it from the pair of first discharge rollers 18 to the sheet post-processing device 30 (see FIG. 1) arranged downstream (to the left in FIG. 2) in the conveying direction. The pairs of relay conveying rollers 39 are composed of upper conveying rollers 39*a* rotatably supported on the upper relay guide 26*a* and lower conveying rollers 39*b* rotatably supported on the lower relay guide 26*b*.

Close downstream of the pair of first discharge rollers 18 in the conveying direction, a discharge conveying passage 37 is formed which branches off the relay conveying passage 35. In a downstream end part of the discharge conveying passage 37, the pair of third discharge rollers 40 is arranged. The pair of third discharge rollers 40 is composed of an upper discharge roller 40*a* and a lower discharge roller 40*b*. In a branch portion between the relay conveying passage 35 and the discharge conveying passage 37, a second branch guide 41 is provided. When a sheet S is discharged onto the discharge tray 29 formed on the top face of the relay conveying unit 26, the sheet S is guided by the second branch guide 41 into the discharge conveying passage 37, and is discharged leftward from the pair of third discharge rollers 40 to be stacked on the discharge tray 29.

The discharge conveying passage 37 is formed by an upper discharge guide 42, which faces the top face of the sheet S, and a lower discharge guide 43, which faces the bottom face of the sheet S. The upper discharge guide 42 is, near a downstream end part of the discharge conveying passage 37, supported by a first pivot shaft 44 extending in the sheet width direction (the direction perpendicular to the plane of FIG. 2) so as to be swingable up and down with respect to the lower discharge guide 43. Owing to the first pivot shaft 44 being provided coaxially with the upper discharge roller 40*a* in the pair of third discharge rollers 40, opening or closing the upper discharge guide 42 does not cause the upper discharge roller 40*a* to move, and allows the discharge conveying passage 37 to be opened wide up to close to the upstream end of the pair of third discharge rollers 40. Although, in this embodiment, the first pivot shaft 44 is provided coaxially with the upper discharge roller 40*a* in the pair of third discharge rollers 40, the first pivot shaft 44 may be provided elsewhere.

Over the relay conveying unit 26, the separate tray 27 is arranged. The separate tray 27 has a body part 27*a* supported at the far side in the in-body discharge space 22 and a movable part 27*b* coupled to the upstream end (on the right side in FIG. 2) of the body part 27*a* in the conveying direction. The movable part 27*b* is supported by a second pivot shaft 45 so as to be swingable up and down with respect to the body part 27*a*. The movable part 27*b* is usually located, as shown in FIG. 2, in a position (hereinafter, the sheet receiving position) where it together with the body part 27*a* forms a sheet stack surface on which sheets S are stacked.

Figure 3:
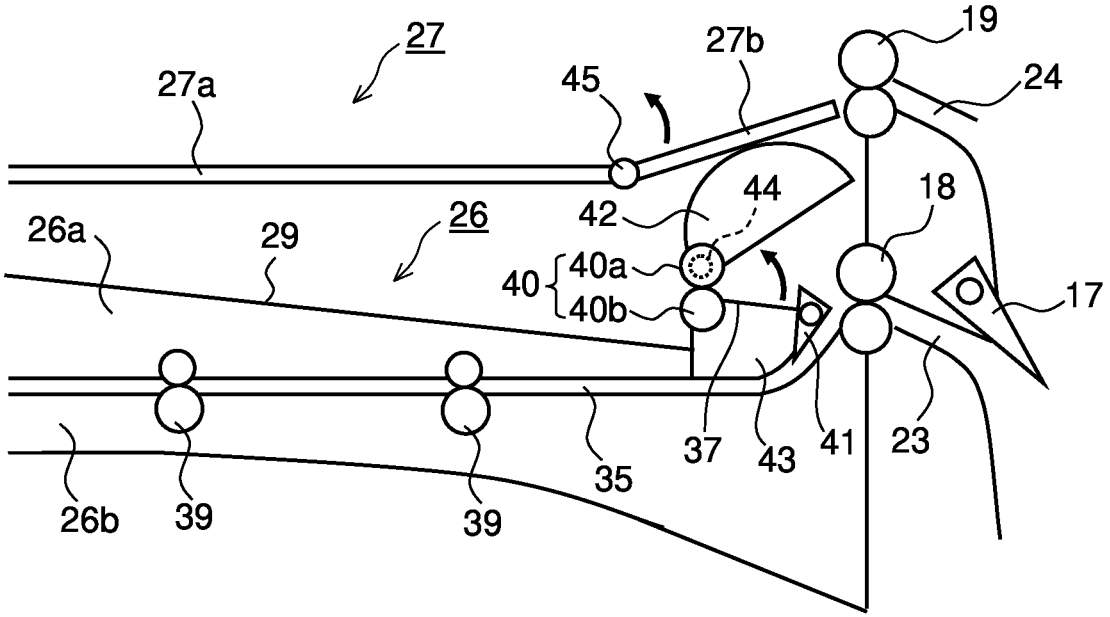
FIG. 3 is a diagram showing a state where an upper discharge guide has swung upward from the state in FIG. 2.

FIG. 3 is a diagram showing a state where the upper discharge guide 42 has swung upward from the state in FIG. 2. If a sheet jam occurs inside the discharge conveying passage 37, swinging the upper discharge guide 42 upward as shown in FIG. 3 permits the discharge conveying passage 37 to be opened, and then the sheet S can be pulled frontward with respect to the image forming apparatus 100 (to the near side with respect to the plane of FIG. 3) to be removed.

In the image forming apparatus 100 of this embodiment, as the upper discharge guide 42 swings upward, the movable part 27*b* of the separate tray 27, which is located over the upper discharge guide 42, swings upward together with the upper discharge guide 42, and the movable part 27*b* moves to a position (hereinafter the retracted position) where it has swung upward from the sheet receiving position. Now, the swinging of the upper discharge guide 42 is no longer restricted by the separate tray 27, and thus the upper discharge guide 42 can swing over a wider range, permitting the discharge conveying passage 37 to be opened wider. This permits easy removal of the sheet S jammed inside the discharge conveying passage 37.

Owing to the first pivot shaft 44 of the upper discharge guide 42 and the second pivot shaft 45 of the movable part 27*b* of the separate tray 27 both extending in the sheet width direction (the direction perpendicular to the plane of FIG. 2), the upper discharge guide 42 and the movable part 27*b* swing in the same direction (sheet discharge direction). Thus, as the upper discharge guide 42 swings upward, the movable part 27*b* smoothly swings upward.

Owing to the second pivot shaft 45 being provided downstream (on the left side in FIG. 3) of the first pivot shaft 44, the movable part 27*b* has a smaller swinging angle than the upper discharge guide 42. Thus, even in a construction where the space over the separate tray 27 is so small that the movable part 27*b* cannot be given a wide swinging range, a sufficient swinging range for the upper discharge guide 42 can be secured.

Figure 4:
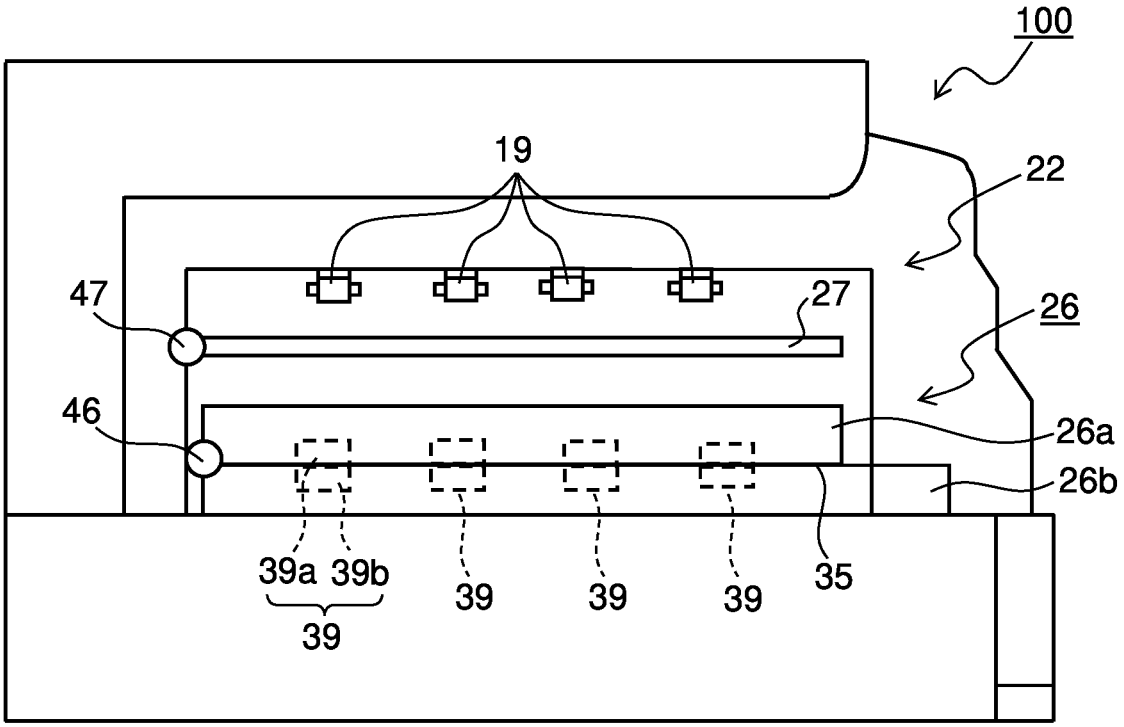
FIG. 4 is a side view, as seen from downstream in the sheet discharge direction, of an in-body discharge space in an image forming apparatus according to a second embodiment of the present disclosure fitted with a relay conveying unit.

FIG. 4 is a side view, as seen from downstream (the left side in FIG. 1) in the sheet discharge direction, of an in-body discharge space 22 in an image forming apparatus 100 according to a second embodiment of the present disclosure fitted with a relay conveying unit 26. In this embodiment, an upper relay guide 26*a* of the relay conveying unit 26 is supported by a third pivot shaft 46 extending along the far side (the left side in FIG. 4) of the in-body discharge space 22 so as to be swingable up and down with respect to a lower relay guide 26*b*. The separate tray 27 is supported on an inner wall surface of the in-body discharge space 22 by a fourth pivot shaft 47 extending along the far side of the in-body discharge space 22 so as to be swingable up and down.

The separate tray 27 is usually located, as shown in FIG. 4, in a sheet receiving position where it forms a sheet stack surface on which sheets S discharged from the pair of second discharge rollers 19 are stacked. In other respects, the relay conveying unit 26 and the image forming apparatus 100 are constructed similarly as in the first embodiment.

Figure 5:
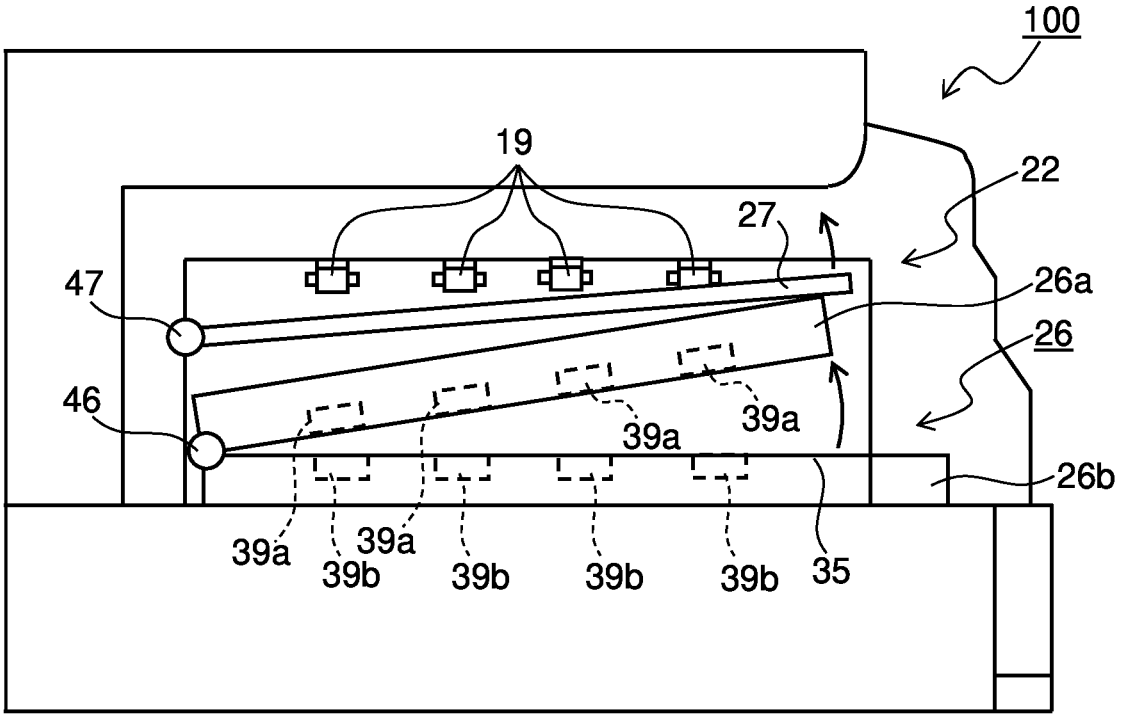
FIG. 5 is a diagram showing a state where an upper relay guide of the relay conveying unit has swung upward from the state in FIG. 4.
Figure 6:
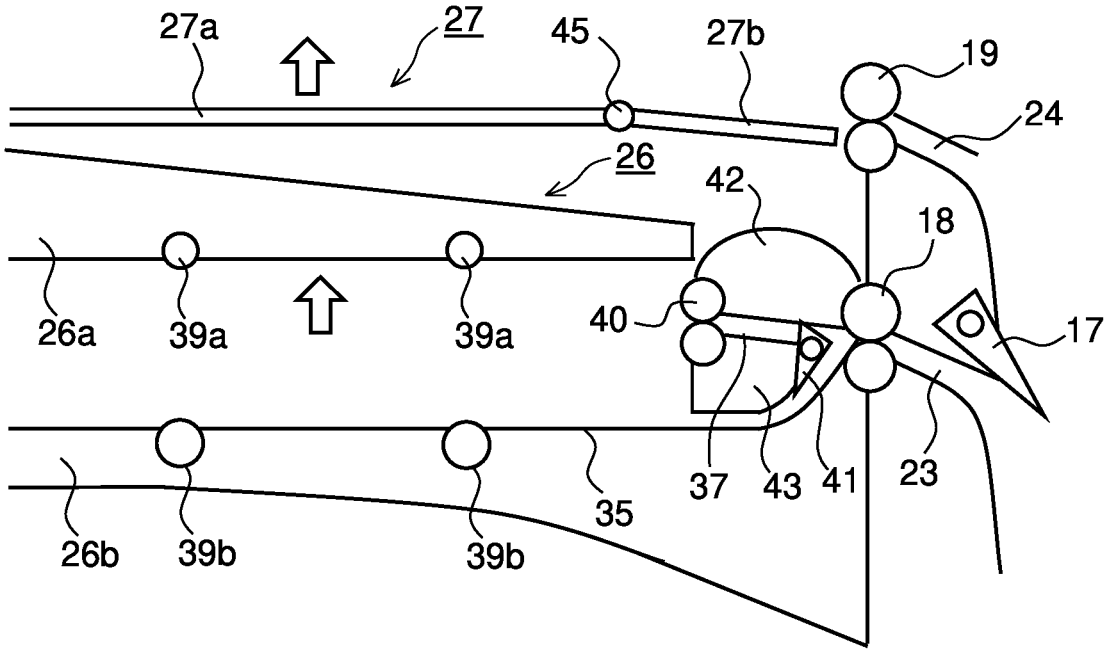
FIG. 6 is a sectional front view of and around the relay conveying unit and a separate tray in the image forming apparatus according to the second embodiment, showing a state where the upper relay guide of the relay conveying unit has swung upward.

FIG. 5 is a diagram showing a state where the upper relay guide 26*a* of the relay conveying unit 26 has swung upward from the state in FIG. 4. FIG. 6 is a sectional front view of and around the relay conveying unit 26 and the separate tray 27, showing a state where the upper relay guide 26*a* of the relay conveying unit 26 has swung upward. If a sheet jam occurs inside the relay conveying passage 35, swinging the upper relay guide 26*a* upward with respect to the lower relay guide 26*b* as shown in FIGS. 5 and 6 permits the relay conveying passage 35 to be opened, and then the sheet S can be pulled frontward with respect to the image forming apparatus 100 (to the right side in FIG. 6, to the near side with respect to the plane of FIG. 6) to be removed.

In the image forming apparatus 100 of this embodiment, as the upper relay guide 26*a* swings upward, the body part 27*a* of the separate tray 27, which is located over the upper relay guide 26*a*, is pushed up by the upper discharge guide 42. Thus, the body part 27*a* together with the upper relay guide 26*a* swings upward to move from the sheet receiving position to the retracted position (see FIG. 5). This gives the upper relay guide 26*a* a wider swinging range, and permits the relay conveying passage 35 to be opened wide. This allows easy removal of the sheet S jammed inside the relay conveying passage 35.

Figure 7:
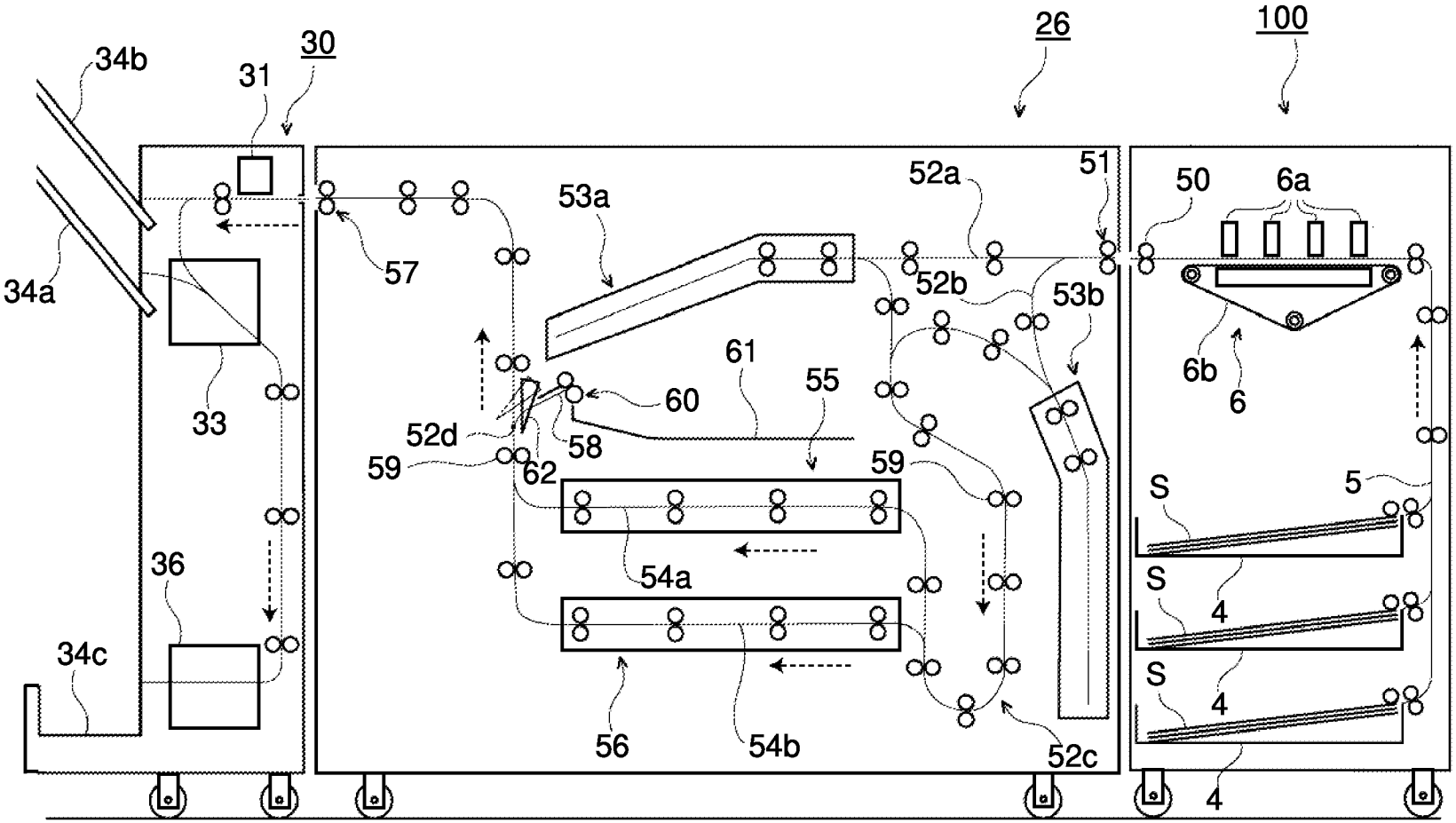
FIG. 7 is a diagram schematically showing an internal construction of an image forming system including a relay conveying unit according to a third embodiment of the present disclosure.

FIG. 7 is a diagram schematically showing an internal construction of an image forming system 200 including a relay conveying unit 26 according to a third embodiment of the present disclosure. With reference to FIG. 7, a description will be given of the image forming system 200, which includes an image forming apparatus 100, a relay conveying unit 26 as one example of a sheet conveying device according to the present disclosure, and a sheet post-processing device 30.

The image forming apparatus 100 is a printer of an inkjet recording type, and includes a sheet feeding portion 4 arranged in a lower part of the image forming apparatus 100, a sheet conveying portion 5 for feeding sheets S stored in the sheet feed portion 4 to an image forming portion 6, and the image forming portion 6 arranged over the sheet feed portion 4.

The image forming portion 6 is composed of a printing head 6*a* and a conveying portion 6*b* arranged to face the printing head 6*a*. The conveying portion 6*b* includes an endless conveying belt 7*a* that is stretched around a plurality of rollers including a driving roller. A sheet S conveyed by the sheet conveying portion 5 passes under the printing head 6*a* while being held on the conveying belt 7*a* under suction by a sheet suction portion provided inward of the conveying belt 7*a*. After having a predetermined image recorded on it, the sheet S is discharged from a pair of discharge rollers 50 to be conveyed into the relay conveying unit 26.

The relay conveying unit 26 in this embodiment is arranged independently between the image forming apparatus 100 and the sheet post-processing device 30, and conveys sheets S discharged from the image forming apparatus 100 to the sheet post-processing device 30. The relay conveying unit 26 performs reversing, whereby it reverses top face down a sheet S having an image recorded on it, and drying, whereby it dries the ink on the sheet S. As shown in FIG. 7, a sheet S conveyed into the relay conveying unit 26 through a relay conveying entrance port 51 passes through a first conveying passage 52*a* to be conveyed into a first reversing conveying passage 53*a*. The first reversing conveying passage 53*a* switches the conveying direction of (switches back) the sheet S conveyed from the first conveying passage 52*a*, and thereby reverses the sheet S top face down.

A second conveying passage 52*b* that branches off the first conveying passage 52*a* is provided, and the sheet S that has passed through the second conveying passage 52*b* is conveyed into a second reversing conveying passage 53*b*. The second reversing conveying passage 53*b* switches the conveying direction of (switches back) the sheet S conveyed from the second conveying passage 52*b*, and thereby reverses the sheet S top face down.

The sheet S reversed top face down by whichever of the first and second reversing conveying passages 53*a* and 53*b* enters a third conveying passage 52*c*. The sheet S is conveyed into a first bypass conveying passage 54*a* and a second bypass conveying passage 54*b* that branch off the third conveying passage 52*c*. The first and second bypass conveying passages 54*a* and 54*b* are provided with a first correction unit 55 and a second correction unit 56 respectively. The first and second correction units 55 and 56 correct the position of the sheet S in its width direction (the direction perpendicular to the plane of FIG. 7).

The sheet S having passed through whichever of the first and second bypass conveying passages 54*a* and 54*b* enters a fourth conveying passage 52*d*. The sheet S passes through the fourth conveying passage 52*d*, and is conveyed via a relay conveying exit port 57 into the sheet post-processing device 30.

An in-body discharge conveying passage 58 that branches off the fourth conveying passage 52*d* is provided, and the sheet S that has passed through the in-body discharge conveying passage 58 is discharged onto a collection tray 61 (sheet stack tray) by a pair of in-body discharge rollers 60. If a sheet jam occurs in the sheet post-processing device 30, a third branch guide 62 provided in a branch portion between the fourth conveying passage 52*d* and the in-body discharge conveying passage 58 switches the conveying passage so that the subsequent sheet S present inside the relay conveying unit 26 is discharged via the in-body discharge conveying passage 58 and the pair of in-body discharge rollers 60 onto the collection tray 61.

Along the first to fourth conveying passages 52*a* to 52*d*, the first and second bypass conveying passages 54*a* and 54*b*, and the in-body discharge conveying passage 58, a plurality of conveying rollers 59 (conveying members) for conveying sheets S are provided at appropriate positions.

Inside the sheet post-processing device 30, there are provided: a punch hole forming device 31 which forms punch holes in sheets S conveyed to it; a stapler 33 which stacks a plurality of sheets S conveyed to it, aligns the end of the bunch of sheets S, and binds it with staples; and a middle-binding and-folding unit 36 which binds a bundle of sheets S at the middle with staples and then folds it at the middle into the form of a brochure. On a side face of the sheet post-processing device 30, there are provided: a main tray 34*a* which is movable up and down to a position suitable for the discharge of sheets S; a sub tray 34*b* which is fixed in an upper part of the sheet post-processing device 30; and a brochure tray 34*c* onto which a bunch of sheets S folded into the form of a brochure by the middle-binding and -folding unit 36 is discharged.

Figure 8:
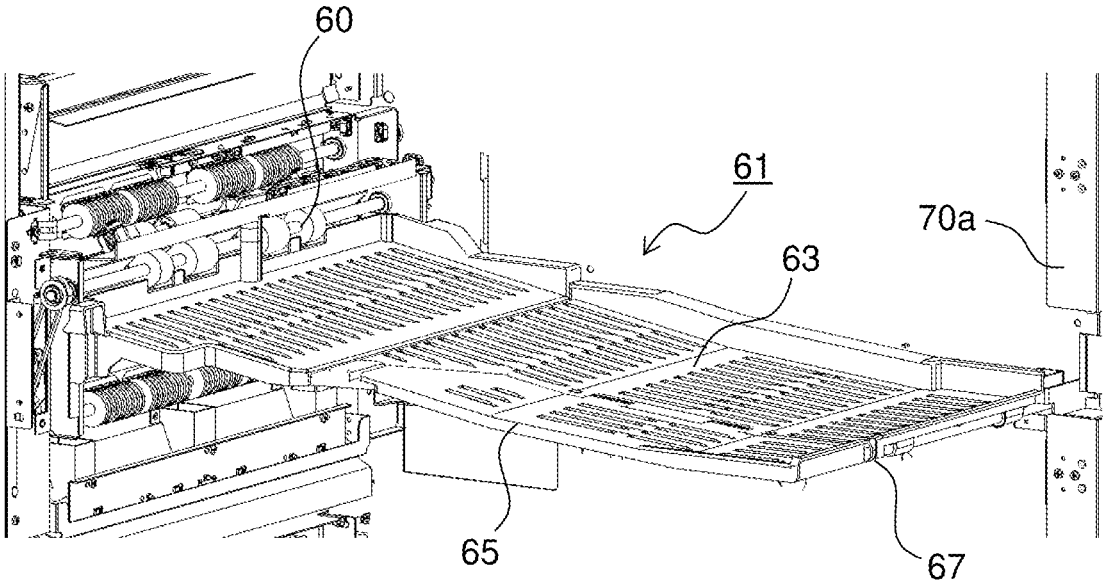
FIG. 8 is a perspective view of and around a collection tray provided inside the relay conveying unit according to the third embodiment.

FIG. 8 is a perspective view of the collection may 61 provided inside the relay conveying unit 26. The collection tray 61 has a collection tray body part 63 and a collection tray movable part 65. The collection tray body part 63 is fastened to a rear frame 70*a* of the relay conveying unit 26. The collection tray movable part 65 is pivotably supported via a hinge portion 67 on the front side (the near side in FIG. 8) of the collection tray body part 63.

Figure 9:
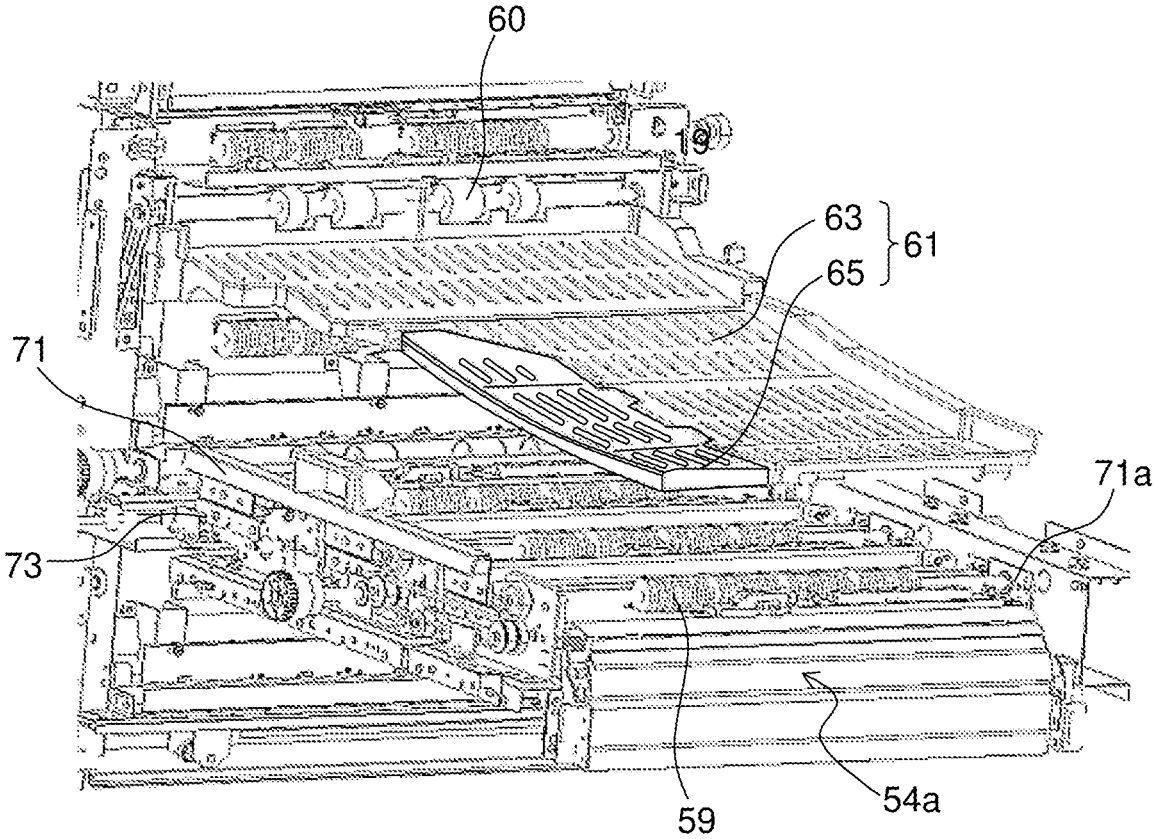
FIG. 9 is a perspective view of the collection tray and a first bypass conveying passage in the relay conveying unit according to the third embodiment, showing a state where a collection tray movable part is located in a sheet receiving position.
Figure 10:
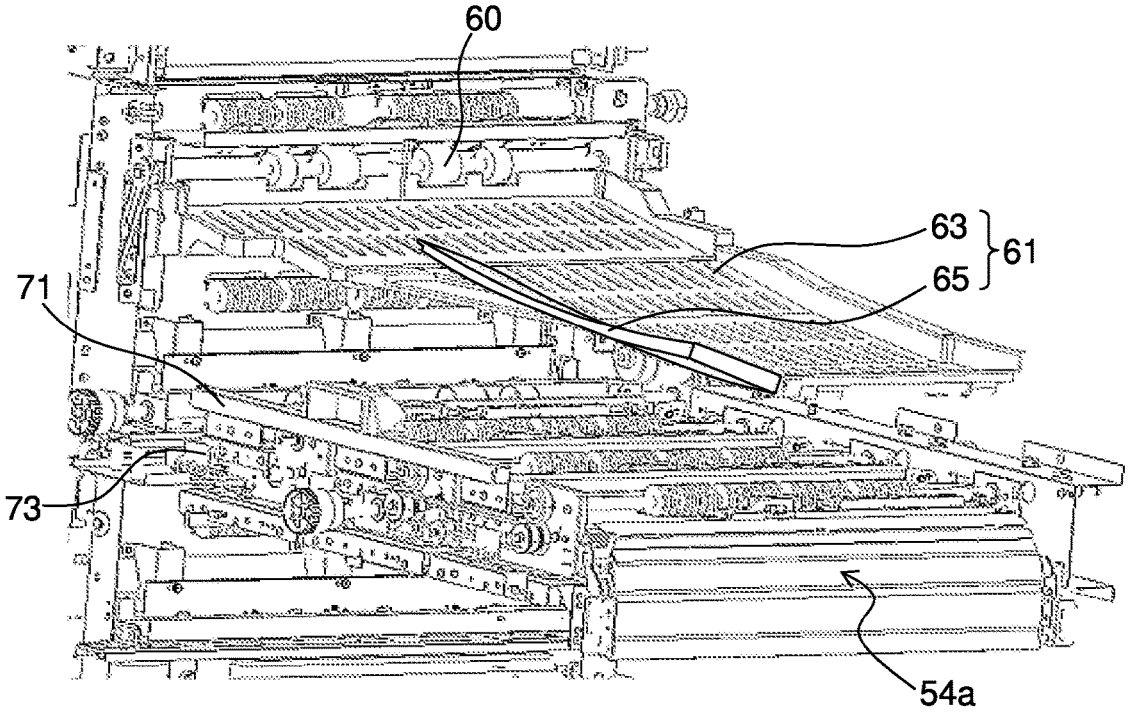
FIG. 10 is a perspective view of the collection tray and the first bypass conveying passage in the relay conveying unit according to the third embodiment, showing a state where the collection tray movable part is located in a retracted position.

FIGS. 9 and 10 are perspective views of the collection tray 61 and the first bypass conveying passage 54*a*, showing states where the collection tray movable part 65 is located in the sheet receiving position and the retracted position respectively.

The first bypass conveying passage 54*a* is arranged under the collection tray 61, and includes an upper conveying guide 71 and a lower conveying guide 73 which face the top face and the bottom face, respectively, of a sheet S. The lower conveying guide 73 constitutes the conveying surface (conveying guide) of the first bypass conveying passage 54*a*. The upper conveying guide 71 supports the upper rollers in the pairs of conveying rollers 59 inside the first bypass conveying passage 54*a*. The lower conveying guide 73 supports the lower rollers in the pairs of conveying rollers 59.

The upper conveying guide 71 is supported so as to be operable-closable up and down with respect to the lower conveying guide 73, with one end part (on the rear side of the relay conveying unit 26, the right side in FIG. 9) of the upper conveying guide 71 in the width direction perpendicular to the conveying direction of sheets S serving as a pivot shaft 71*a*, and with another end part of the upper conveying guide 71, opposite from the pivot shaft 71*a*, at the front side (the near left side in FIG. 9) of the relay conveying unit 26, serving as a swinging end.

During ordinary image formation, the collection tray movable part 65 is located in a sheet receiving position as shown in FIGS. 8 and 9. The collection tray movable part 65 located in the sheet receiving position is flush with the collection tray body part 63, and together with the collection tray body part 63 forms the sheet stack surface on which sheets S discharged from the pair of in-body discharge rollers 60 are stacked. The collection tray movable part 65 can move to a retracted position where it has swung upward from the sheet receiving position.

Figure 11:
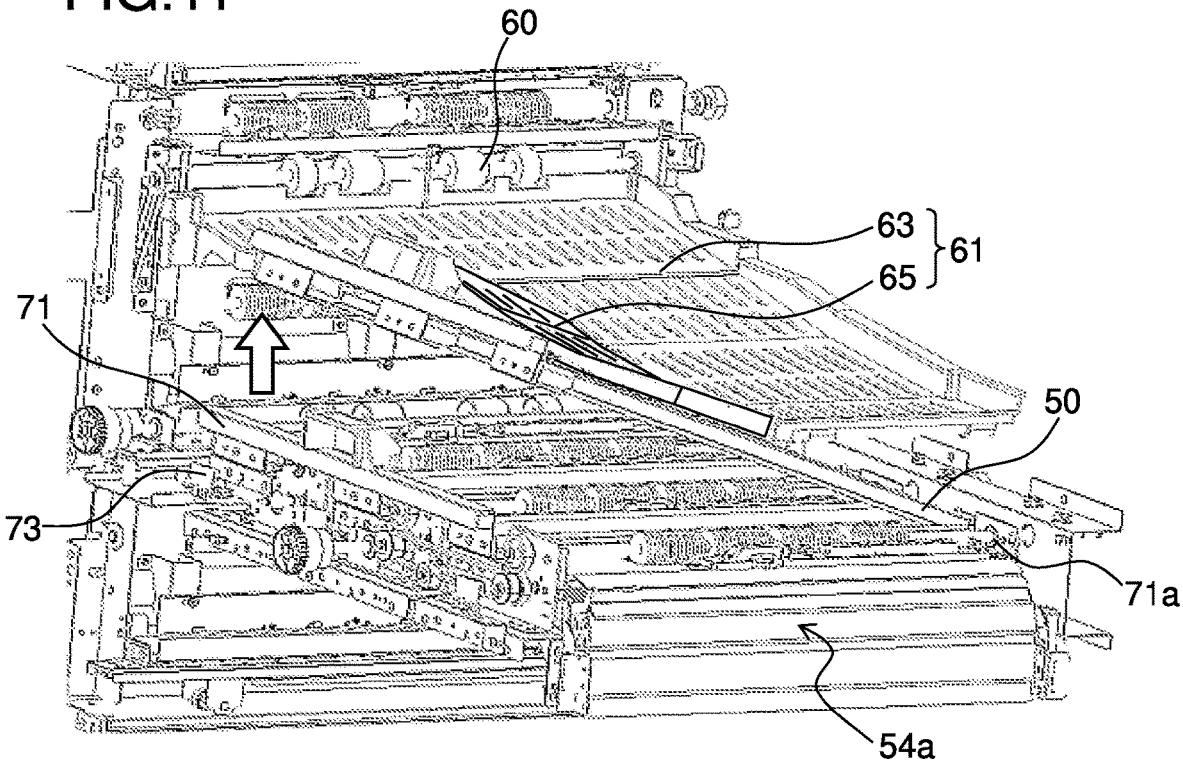
FIG. 11 is a perspective view of the collection tray and the first bypass conveying passage in the relay conveying unit according to the third embodiment, showing a state where the upper conveying guide of the first bypass conveying passage is open.

FIG. 11 is a perspective view showing a state where the upper conveying guide 71 is open. When a sheet S conveyed into the first bypass conveying passage 54*a* has jammed, swinging the swinging end of the upper conveying guide 71 upward permits the conveying surface to be opened from the front side (the left side in FIG. 11) of the relay conveying unit 26. This separates the upper and lower conveying rollers constituting the pairs of conveying rollers 59, and then the jammed sheet S can be pulled frontward with respect to the relay conveying unit 26 (leftward in FIG. 11) to be removed.

As shown in FIG. 11, the collection tray movable part 65 is located right over the upper conveying guide 71. Thus, as the upper conveying guide 71 is swung upward, the collection tray movable part 65 is pushed upward by the upper conveying guide 71 to move from the sheet receiving position to the retracted position.

Thus, even with the construction where the collection tray 61 is arranged right over the first bypass conveying passage 54*a*, the upper conveying guide 71 can be opened with no interference between the collection tray 61 and the upper conveying guide 71; thus the upper conveying guide 71 can be opened and closed smoothly on the occasion of dealing with a jam. It is thus possible to achieve space saving with the space for arrangement of the collection tray 61, and to obtain increased flexibility in the layout inside the relay conveying unit 26.

The scope of the present disclosure is not limited by the embodiments described above and allows for various modifications without departure from the spirit of the present disclosure. For example, while in the first embodiment the upper discharge guide 42 swings in the conveying direction, the upper discharge guide 42 may instead swing in the sheet width direction. In that case, the movable part 27*b* of the separate tray 27, which is located over the upper discharge guide 42, may swing together in the sheet width direction such that the upper discharge guide 42 and the movable part 27*b* swing in the same direction.

While in the embodiments described above, as examples of sheet conveying devices, an image forming apparatus 100 including a separate tray 27 over a removable relay conveying unit 26 and a relay conveying unit 26 including a collection tray 61 over a first bypass conveying passage 54*a* inside the apparatus are described, the present disclosure is applicable to any other image forming apparatuses 100, relay conveying units 26, and sheet post-processing devices 30 so long as they are so constructed as to have a sheet stack tray over a conveying passage.

The present disclosure is applicable not only to monochrome multifunction peripherals like the one shown in FIG. 1 and inkjet printers like the one shown in FIG. 7 but also to a variety of image forming apparatuses such as color multifunction peripherals, monochrome and color printers, and facsimile machines.

The present disclosure finds application in sheet conveying devices for conveying sheets. Based on the present disclosure, it is possible, with constructions where a sheet stack tray is provided over a conveying passage, to provide a sheet conveying device that can avoid, when the conveying passage is opened and closed, its interference with the sheet stack tray, and to provide an image forming apparatus incorporating such a sheet conveying device.

What is claimed is:

1. A sheet conveying device, comprising:

a sheet conveying passage through which a sheet discharged from a pair of first discharge rollers is conveyed;

an upper conveying guide that faces an upper surface of the sheet passing through the sheet conveying passage;

a lower conveying guide that faces a lower surface of the sheet passing through the sheet conveying passage; and a sheet stack tray that is arranged above the upper conveying guide and on which the sheet discharged from a pair of second discharge rollers disposed above the pair of first discharge rollers is stacked, wherein the upper conveying guide is swingable up and down, with one end of the upper conveying guide in a sheet conveying direction or one end of the upper conveying guide in a sheet width direction perpendicular to the sheet conveying direction serving as a pivot shaft, and the sheet stack tray has a movable part that makes contact with the upper conveying guide at least when the upper conveying guide swings, the movable part being movable between a sheet receiving position where the movable part forms a sheet stack surface on which the sheet is stacked and a retracted position where the movable part has swung upward from the sheet receiving position.

2. An image forming system, comprising:

the sheet conveying device according to claim 1, the sheet conveying device conveying, with the conveying member, the sheet formed an image thereon by an image forming portion; and a sheet post-processing device that is coupled downstream of the sheet conveying device in the sheet conveying direction and that performs predetermined post-processing on the sheet.

3. An image forming system, comprising:

the sheet conveying device according to claim 1;

an image forming apparatus that is connected upstream of the sheet conveying device in the sheet conveying direction and that forms an image on the sheet; and a sheet post-processing device that is connected downstream of the sheet conveying device in the sheet conveying direction and that performs predetermined post-processing on the sheet.

4. A sheet conveying device, comprising:

a sheet conveying passage through which a sheet passes;

an upper conveying guide that faces an upper surface of the sheet passing through the sheet conveying passage;

a lower conveying guide that faces a lower surface of the sheet passing through the sheet conveying passage;

a conveying member that conveys the sheet along the sheet conveying passage; and a sheet stack tray that is arranged above the upper conveying guide and on which the sheet is stacked, wherein the upper conveying guide is swingable up and down, with one end of the upper conveying guide in a sheet conveying direction or one end of the upper conveying guide in a sheet width direction perpendicular to the sheet conveying direction serving as a pivot shaft, the sheet stack tray has a movable part that makes contact with the upper conveying guide at least when the upper conveying guide swings, the movable part being movable between a sheet receiving position where the movable part forms a sheet stack surface on which the sheet is stacked and a retracted position where the movable part has swung upward from the sheet receiving position, the conveying member includes:

a pair of first discharge rollers; and a pair of second discharge rollers provided above the pair of first discharge rollers, the sheet conveying passage includes:

a first conveying passage where the pair of first discharge rollers is disposed;

a second conveying passage that branches off from the first conveying passage and in which the pair of second discharge rollers is disposed;

a relay conveying passage configured to deliver the sheet discharged from the pair of first discharge rollers to a sheet carry-in device coupled to a downstream side in the sheet conveying direction; and a discharge conveying passage that is formed to branch off the relay conveying passage and that guides the sheet discharged from the pair of first discharge rollers to a discharge tray formed on an upper surface of an upper relay guide, the upper conveying guide includes:

the upper relay guide that faces the upper surface of the sheet passing through the relay conveying passage; and an upper discharge guide that faces the upper surface of the sheet passing through the discharge conveying passage, the sheet stack tray includes a separate tray that is arranged above the relay conveying passage and the discharge conveying passage and on which the sheet discharged from the pair of second discharge rollers is stacked, the separate tray includes:

a body part that constitutes the sheet stack surface; and the movable part that is connected to the body part and that is swingable to above the upper discharge guide, and the movable part is pivotally supported on the body part, with one end side of the movable part in the sheet conveying direction or one end side of the movable part in the sheet width direction as a rotation axis, is swingable with respect to the body part, and moves between the sheet receiving position and the retracted position by swinging of the upper discharge guide.

5. The sheet conveying device according to claim 4, wherein the upper discharge guide is supported so as to be swingable up and down by a first pivot shaft provided at a downstream end of the upper discharge guide in the sheet conveying direction and extending in the sheet width direction, the movable part is supported, at a downstream end thereof in the sheet conveying direction, on the body part so as to be swingable up and down by a second pivot shaft extending in the sheet width direction, the movable part swinging, with an upstream end thereof in the sheet conveying direction serving as a swinging end, in a same direction as the upper discharge guide.

6. The sheet conveying device according to claim 5, wherein the second pivot shaft is disposed downstream of the first pivot shaft in the sheet conveying direction.

7. The sheet conveying device according to claim 5, wherein the conveying member includes a pair of third discharge rollers that discharges the sheet passing through the discharge conveying passage onto the discharge tray, the pair of third discharge rollers includes an upper discharge roller and a lower discharge roller, and the first pivot shaft is provided coaxially with the upper discharge roller.

8. The sheet conveying device according to claim 4, wherein the lower conveying guide includes a lower relay guide that faces the lower surface of the sheet passing through the relay conveying passage, the upper relay guide forms a top surface of the relay conveying passage, and is supported on a lower relay guide forming a bottom surface of the relay conveying passage so as to be swingable up and down by a third pivot shaft extending in the sheet conveying direction, the body part is supported so as to be swingable in a same direction as the upper relay guide by a fourth pivot shaft extending in the sheet conveying direction, and when the upper relay guide swings, the body part makes contact with the upper relay guide so as to be movable between the sheet receiving position and the retracted position.

9. A sheet conveying device, comprising:

a sheet conveying passage through which a sheet passes;

an upper conveying guide that faces an upper surface of the sheet passing through the sheet conveying passage;

a lower conveying guide that faces a lower surface of the sheet passing through the sheet conveying passage;

a conveying member that conveys the sheet along the sheet conveying passage; and a sheet stack tray that is arranged above the upper conveying guide and on which the sheet is stacked, wherein the upper conveying guide is swingable up and down, with one end of the upper conveying guide in a sheet conveying direction or one end of the upper conveying guide in a sheet width direction perpendicular to the sheet conveying direction serving as a pivot shaft, the sheet stack tray has a movable part that makes contact with the upper conveying guide at least when the upper conveying guide swings, the movable part being movable between a sheet receiving position where the movable part forms a sheet stack surface on which the sheet is stacked and a retracted position where the movable part has swung upward from the sheet receiving position, the sheet stack tray is a collection tray to which the sheet remaining in the sheet conveying passage is retracted to be collected.

10. The sheet conveying device according to claim 9, wherein the collection tray includes:

a collection tray body part that constitutes the sheet stack surface; and a collection tray movable part that is formed in a part of the collection tray body part making contact with the upper conveying guide when the upper conveying guide swings upward and that is movable between the sheet receiving position and the retracted position.

* * * * *